United States Patent [19]

Piston et al.

[11] 4,278,909

[45] Jul. 14, 1981

[54] MODIFIED CONDUCTOR ARRAY FOR PLASMA DISPLAY PANEL

[75] Inventors: Albert O. Piston, Catskill; Thomas A. Sherk, West Hurley, both of N.Y.

[73] Assignee: International Business Machines Corporation, Armonk, N.Y.

[21] Appl. No.: 57,531

[22] Filed: Jul. 13, 1979

[51] Int. Cl.[3] ..... H01J 17/04; H01J 61/06; H01J 63/02

[52] U.S. Cl. ..... 313/217

[58] Field of Search ..... 313/217, 517, 220

[56] References Cited

U.S. PATENT DOCUMENTS

| | | | |
|---|---|---|---|
| 4,070,599 | 1/1978 | Uchikoba et al. | 313/497 |
| 4,100,456 | 7/1978 | Kobayakawa et al. | 313/220 X |

OTHER PUBLICATIONS

Chang et al., IBM Technical Disclosure Bulletin, vol. 19, #10, Mar. 1977, pp. 3951 and 3952.

*Primary Examiner*—Robert Segal

*Attorney, Agent, or Firm*—Joseph J. Connerton

[57] ABSTRACT

In plasma display panels requiring interstitial spacer elements within the display area to provide and maintain a uniform discharge gap, the spacers are positioned between lines which constitute the display. The lines adjacent the spacer elements experience a significant decrease in operating margin. This margin decrease is compensated for by either jogging the lines adjacent the spacers outwardly, by widening the lines in the affected areas or a combination of both. Various embodiments for providing this compensation are illustrated and described.

10 Claims, 4 Drawing Figures

MODIFIED CONDUCTOR ARRAY FOR PLASMA DISPLAY PANEL

CROSS REFERENCE TO RELATED APPLICATIONS

U.S. application Ser. No. 841,186 "Improved Gas Panel Spacer" filed by Charles H. Perry Oct. 11, 1977.

U.S. application Ser. No. 4,098 "Improved Gas Panel Fabrication" filed by Charles H. Perry Jan. 17, 1979.

BACKGROUND OF THE INVENTION

The present invention relates to plasma display panels and more particularly to an improved conductor configuration to compensate for the reduced operating margin resulting from the use of interstitial spacer elements in plasma display devices.

In plasma display devices, parallel conductor arrays are formed on a pair of glass plates, overcoated with a dielectric and a dielectric protective layer and the plates then sealed into an envelope filled with an ionizable gas under pressure with the conductor arrays disposed substantially orthogonal to each other, the conductor intersections defining the individual gas discharge cell electrodes. One of the critical parameters in such display devices is the discharge or chamber gap, ie, the distance between opposite walls of the cells, which must be maintained substantially uniform across the entire surface of the display panel, a particular problem in large size panels of high resolution. Such gaps in smaller display devices are generally provided by spacer rods which are positioned about the periphery of the panel. However, in large size panels, it is necessary to utilize in addition a configuration of interstitial spacer elements within the panel display area, such spacer elements being in the form of metallic rods which are interspersed between adjacent conductors on one of the plates. The referenced copending Application Ser. No. 841,186 relates to an interstitial spacer system for a plasma display panel in which a plurality of metallic spacer elements are positioned at the predetermined locations on the screen to provide and maintain a uniform discharge gap. One problem associated with interstitial spacers is they affect the performance of the adjacent cells. When a spacer is placed between two normal cell lines or electrodes, it caused the voltage level of the spacer element to be shifted upward. Stated another way, it distorts the electric field intensity for the discharge cells adjacent the spacer element and the field strength is thus reduced. As a result, these cells will not turn on when the panel is operated at the normal sustain voltage, or if turned on, will extinguish rapidly. While the spacer elements are designed to fit between conductors and the technology to bond the spacer element to one of the dielectric surfaces is available, failure of cells adjacent to the spacer elements such as described above frequently occurs, when the electrical parameters of those conductors adjacent the spacer elements are altered.

The primary electrical parameter of plasma display devices is the panel margin, defined as the difference between the maximum and minimum sustain voltage at which all cells are required to sustain only a single cell. This parameter, designated $V_s$max. $-V_s$min., required a nominal margin of approximately 10 volts for operation. However, when metallic spacers are positioned within a panel, both the maximum and minimum sustain voltage of cells immediately adjacent the spacers shift upward dynamically although at differing rates, reducing the margin by 30–40% volts. In addition to difficulty in turning such cells on, those cells which are turned on extinguish more readily, producing clusters of off cells adjacent the spacer areas which are cosmetically undesirable. Such cells also constitute the weak points in a panel, and are susceptible to premature aging. Thus there exists a requirement to compensate for any modification of the characteristics of conductors adjacent to spacer elements whereby all cells, including those adjacent the spacer elements, may be driven with the same signal levels.

SUMMARY OF THE INVENTION

In accordance with the instant invention, the shift in operating voltage of cells adjacent the spacer elements is compensated for by modifying the geometry of the electrodes adjacent the spacer elements. In one embodiment of the invention, the conductors adjacent the spacer are jogged outwardly from the spacer to increase the distance between the spacers and adjacent electrodes. In other embodiments of the invention, the electrodes adjacent the spacer are widened toward the spacer, away from the spacer or on both sides thereof. The invention is described in terms of a preferred embodiment of a plasma panel constructed in accordance with the teachings of the instant invention with specific physical and electrical parameters relating thereto.

DESCRIPTION OF THE PREFERRED EMBODIMENT

Figure 1:
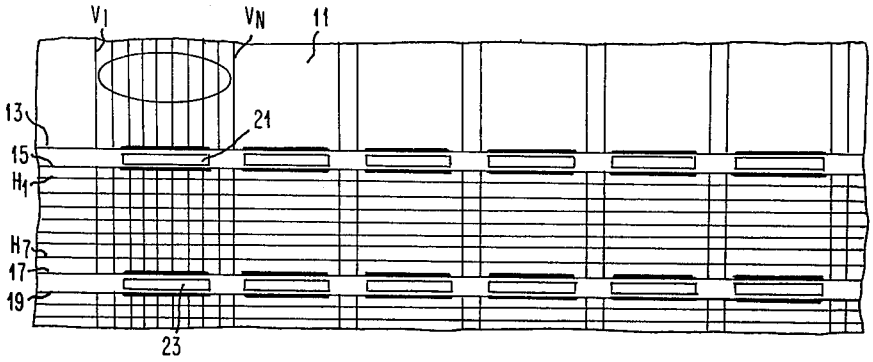
FIG. 1 is an enlarged view of a portion of a gaseous discharge display device illustrating a conductor and spacer environment for a plasma display panel.

Referring now to the drawings and more particularly to FIG. 1 thereof, there is illustrated an enlarged schematic plan view of a portion of a gas discharge display device. The gas panel display device and method of fabrication of the instant invention corresponds to that shown and described in U.S. Pat. No. 3,837,724 to Haberland et al, which is incorporated herein by reference, except as they relate to details of the invention pointed out below. With respect to the model constructed in accordance with the teaching of the instant invention, the resolution of the panel is approximately 70 lines/inch using 3 mil. lines on 14 mil. centers. The spacer elements correspond to those shown in the referenced copending Application Ser. No. 841,186 and are 5 mils. wide, 4 mils. thick and 250–280 mils. long. It should be noted that FIGS. 1–5 are not drawn to scale, but are intended to illustrate the environment and clarify the novel aspects of the instant invention.

The gas panel 11 shown in FIG. 1 is comprised of two glass plates not visible in the drawing, the back plate having horizontal conductors 13, 15 and 17, 19 positioned on opposite but adjacent sides of spacer elements 21, 23 respectively. The spacer elements are bonded to the back plate between adjacent horizontal conductors. Conductors $H_1$–$H_7$ identify 7 horizontal conductors which could be used to generate characters in a $5\times7$ character matrix, for example, while vertical conductors $V_1$–$V_n$ comprise those electrodes on the front plate necessary for character generation. While the space shown in FIG. 1 for positioning spacer elements 21, 23 is portrayed as greater than the normal spacing between horizontal conductors, it will be recognized that this represents an idealized situation in which rows of conductors would be separated as shown, with the spacers located between rows. In most practical embodiments the spacers are positioned at predetermined locations between adjacent conductors, the situation which produces the problem solved by the instant invention, with the number and location of spacers determined largely by the panel size. Since the spacing of the elements 21, 23 in the conductor matrix is critical, the spacers 21, 23 are assumed to be positioned within ±1 mil. of the center between adjacent conductors 13, 15 and 17, 19 to minimize electrical interference. While not necessary to an understanding of the invention, the spacers 21, 23 comprise a nickel iron alloy having an oxidized coating on the surface to minimize reflections and render the spacers substantially non-visible to viewers, while they may be secured in the dielectric of the back plate in the preferred embodiment by conventional thermal compression or ultrasonic bonding techniques.

Figures 2, 3, 4, 5:
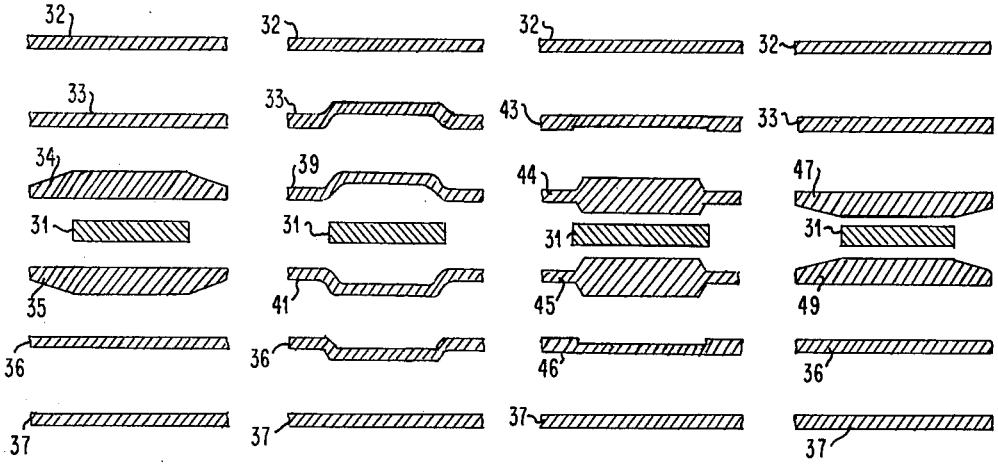
FIGS. 2, 3, 4 and 5 illustrate conductor configurations utilized in various embodiments of the present invention.

Referring now to FIGS. 2–5, there are illustrated therein various conductor-spacer configurations designed to compensate for the aforedescribed margin changes in those cells adjacent the spacers. Referring initially to FIG. 2, the spacer 31 corresponds to spacer 21, 23 in FIG. 1. Conductors 32–37 correspond to conductors $H_1$, $H_2$, . . . $H_7$ designating the conventional line width in the particular configuration. In the preferred embodiment previously described, these conductors may be 3 mils. wide and spaced on 14 mil. centers, while the spacer elements 31 are 5 mils. wide and approximately 250–280 mils. long. Assuming the spacer is precisely positioned between adjacent conductors 34, 35, higher voltages would be normally required to operate the adjacent cells. This phenomenon is either due to a wall effect of the spacer on adjacent conductors, or distortion of the electric field due to physical interference by the spacer location. By widening the lines around the spacer, adjacent cell areas increased thereby increasing the electric field strength for a given applied voltage. This effect offsets the decrease in field strength caused by the presence of the spacer rods. Accordingly, conductors 34, 35 on opposite sides of the spacer element 31 are selectively wider in the area immediately adjacent to the spacer. A side effect of widening lines in this manner is that it reduces the distance between the widened lines and their adjacent conductors 33, 36 is reduced causing increased field strength on those cells two lines away from the spacer. This effect can be compensated by slightly jogging these lines in the manner shown in FIG. 5 and more fully described hereinafter. It should be noted that none of the conductor configuration embodiments shown in FIGS. 2–5 create any additional fabrication problems, since the mask could be designed for any specified conductor configuration, although straight line tapering is preferred for computer generated masks.

Referring now to FIG. 3, the spacer element 31 and the outer conductors 32, 33 and 36, 37 are identical to those shown in FIG. 2. However, rather than widening the conductors adjacent to the spacer 31, conductors 39 and 41 are jogged outwardly in the area adjacent spacer 31 so that they are displaced a greater distance from the spacer. This embodiment provides an alternative solution to compensate for the margin problem caused by the spacers. This jogging of conductors 39 and 41, depending on panel resolution, may cause a increase in field strength in their immediate adjacent conductors 33 and 36 respectively. Where this occurs, conductors 33, 36 may also be jogged outwardly but to a distance approximately half that of conductors 39, 41 respectively. The FIG. 3 embodiment might be employed in a high resolution panel in which the distance between conductors would permit jogging but not accommodate wider lines. By increasing the distance between the jogged conductors and the spacer elements, the electric field disturbance is substantially reduced thereby normalizing all voltages.

Referring now to the embodiment illustrated in FIG. 4, the lines 47, 49 adjacent spacer 31 are widened on the side adjacent the spacer element 31, an inverted representation of conductor configurations 34, 35 of FIG. 2. This configuration was the least effective of the various embodiments since it impacted the area of field disturbance by the fan-out in line width toward the spacer rather than away from the spacer as shown in FIG. 2.

The final and preferred embodiment shown in FIG. 5 is formed by widening both sides of the two conductors adjacent the spacer. Conductors 44 and 45 are widened on both edges such that the maximum conductor width is provided in the area immediately adjacent in the spacer on both sides thereof. As previously described, a side effect of widening the lines is that it reduces the distance between the widened and their adjacent lines, thereby causing $V_s$max. to downshift on the cells two lines away from the spacer due to charge spreading. This is compensated for by jogging the line width of immediately adjacent lines 43, 46 in the manner shown, while the remaining lines 32 and 37 are identical to the other configurations. In the preferred embodiment constructed in accordance with the teaching of the instant invention, the normal 3 mil. line width was increased 1 mil. on either side of the spacer, so that conductors 44 and 45 tapered to a 5 mil. width at the area adjacent the spacer. Lines 43 and 46 were reduced by 0.5 mils on the spacer side of the lines as shown to reduce the $V_s$max. downshifts to a level more compatible to the upshift created by the spacer composition and location. The objectives of the FIG. 5 configuration is to optimize the total panel margin and avoid hot cells (cells with a low $V_s$max.) which come into play at the end of the widened lines adjacent the spacer. The hot cell problem is alleviated by forming a symmetrical taper on lines 44,45 on both sides of the 5 mil. wide lines. A symmetrical 20 mil. taper on each side of the 5 mil. area of lines 44, 45 is used to eliminate the hot cell problem. The taper on conductors 44, 45 extended 8 mils. from the end of the rod to 12 mils. with the area immediately adjacent to the rod on both sides. A computer simulation indicated that the FIG. 5 embodiment represents the optimum electrode configuration.

From the above description, conductor configuration selections can be made for a plasma display device, the criteria including the resolution of the panel but also including the physical parameters of the spacer element such as composition, location, number of spacers etc. Depending on the specified line resolution and various interelated physical parameters of the spacer such as composition, size, placement etc., an appropriate embodiment can be selected from those shown in FIGS. 2–5 or modifications thereof. If necessary, models of various configurations could be provided and individually tested or simulated to determine which embodiment would provide the optimum selection for a specific panel design. Specific parameters for a particular line resolution have been described which afford illustrative embodiments which should accommodate any desired size panel of any specified resolution.

While the invention has been particularly shown and described with reference to preferred embodiments thereof, it will be understood by those skilled in the art that various changes in form and detail may be made therein without departing from the spirit and scope of the invention.

Having thus described my invention, what I claim as new, and desire to secure by Letters Patent is:

1. A gaseous discharge display device comprising in combination, a pair of glass plates, each of said glass plates having a conductor array formed thereon, a dielectric coating over each of said conductor arrays, spacer means comprising a plurality of spacer elements for providing and maintaining a uniform discharge gap between said glass plates, said spacer means comprising a plurality of metallic spacer elements located at predetermined positions on one of said plates, said spacer elements having a configuration adapted to fit between adjacent parallel conductors on said one of said glass plates, and means for symmetrically modifying the physical parameters of said conductors adjacent said spacer elements to compensate for modification of the operating characteristics of said adjacent conductors resulting from the proximate location of said spacer elements.

2. A device of the type claimed in claim 1 wherein said modification of the physical parameters of said conductors adjacent said spacer elements comprises modifying the position of said adjacent conductors relative to said spacer elements.

3. A device of the type claimed in claim 1 wherein said modification of the physical parameters of said conductors adjacent said spacer elements comprises modifying the area of said adjacent conductors.

4. A device of the type claimed in claim 2 wherein said modification of the position of said adjacent conductors comprises jogging said conductors outwardly in the area adjacent said spacer elements.

5. A device of the type claimed in claim 3 wherein said modification of the area of said adjacent conductors comprises widening said conductors in the area adjacent said spacer elements.

6. A device of the type claimed in claim 5 wherein said widening of said conductors is provided on the outer edge of said conductors adjacent said spacer elements.

7. A device of the type claimed in claim 5 wherein said widening of said conductors comprises widening said conductors in the inner edge of adjacent said spacer elements.

8. A device of the type claimed in claim 5 wherein said widening of said conductors is provided on both edges of said conductors in the area adjacent said spacer elements.

9. A device of the type claimed in claim 8 wherein the conductors removed from said spacer elements are also modified in the area adjacent said spacer elements.

10. A device of the type claimed in claim 9 wherein said second set of modified conductors are narrowed in the area adjacent said spacer element.

* * * * *